United States Patent [19]

Tanaka et al.

[11] 4,385,107

[45] May 24, 1983

[54] DRY TONERS COMPRISING A COLORANT AND GRAPH COPOLYMER COMPRISING A CRYSTALLINE POLYMER AND AN AMORPHOUS POLYMER AND PROCESSES USING THE SAME

[75] Inventors: Koichi Tanaka; Yoshimi Amagai; Shigeo Aonuma; Hiroshi Takayama, all of Kanagawa, Japan

[73] Assignee: Fuji Photo Film Co., Ltd., Tokyo, Japan

[21] Appl. No.: 259,780

[22] Filed: May 1, 1981

[30] Foreign Application Priority Data

May 1, 1980 [JP] Japan ..... 55-58321
May 1, 1980 [JP] Japan ..... 55-58322

[51] Int. Cl.[3] ..... G03G 9/00

[52] U.S. Cl. ..... 430/98; 430/109; 430/904; 430/124

[58] Field of Search ..... 430/109, 904, 98, 99, 430/124

[56] References Cited

U.S. PATENT DOCUMENTS 3,853,778 12/1974 Buckley ..... 430/109
3,965,021 6/1976 Clemens ..... 430/109
4,108,653 8/1978 Peters ..... 430/109

*Primary Examiner*—John E. Kittle
*Assistant Examiner*—John L. Goodrow
*Attorney, Agent, or Firm*—Sughrue, Mion, Zinn, Macpeak and Seas

[57] ABSTRACT

A dry toner that is heat-fixable and/or press-fixable is disclosed, comprising (a) a colorant; and (b) a graft copolymer comprising (i) a crystalline polymer having a melting point of from 45° C. to 200° C., which is prepared from one or more monomers selected from ethylene, propylene and vinyl acetate, and (ii) an amorphous polymer having a glass transition point of 45° C. or more, which is prepared from one or more vinyl monomers.

18 Claims, No Drawings

DRY TONERS COMPRISING A COLORANT AND GRAPH COPOLYMER COMPRISING A CRYSTALLINE POLYMER AND AN AMORPHOUS POLYMER AND PROCESSES USING THE SAME

FIELD OF THE INVENTION

The present invention relates to dry toners for use in the development of electrostatic latent images in electrophotography, electrostatic recording, electrostatic printing and so forth. More particularly, it relates to dry toners in which graft copolymers are used as binder resins.

BACKGROUND OF THE INVENTION

In copying a manuscript, etc., an electrostatic latent image is first formed on a light-sensitive medium or electrostatic medium film, and then is developed by attaching thereonto fine particles which are prepared by dispersing a colorant in a binder resin; such dispersions are called "toners". The toner image thus formed is then transferred to the surface of a support, such as paper, and is fixed thereon, for example, by heating. For the fixation of the toner image, a heat-fixation method is ordinarily used in which the toner image is heated to a temperature at which the toner melts and flows, and is then melt-adhered to the support to provide a final copy, although methods such as solvent-treatment and overcoating-treatment are also known. As this heat-fixation method, the so-called heat roll fixation method, i.e., a method in which a support bearing thereon a toner image is inserted between a pair of rolls consisting of a heat roll and a pressure-application roll where it is heated under pressure to perform the fixation, has been used in view of the speed of copying.

The heat roll fixation method is very effective, in that the thermal efficiency is high, the heat dissipation is low, and rapid fixation is possible, compared with other heat-fixation methods.

This heat roll fixation method, however, is liable to cause the so-called off-set phenomenon, i.e., a phenomenon that part of toner images sticks to the heat roll or pressure-application roll, because the toner image comes into contact with the roll. In order to prevent the foregoing phenomenon, heretofore, the surface of the roll has been coated with a material having excellent releasability, such as a fluorine resin, and furthermore, an off-set preventing liquid, such as silicone oil, has been supplied onto the surface of the roll. This produces the effect of preventing the off-set phenomenon to a certain extent. However, this technique has disadvantages in that the off-set preventing liquid is required, an apparatus to always supply a constant amount of off-set preventing liquid onto the surface of the roll is required, oil-leakage occurs, and in that the off-set preventing liquid produces odor resulting from the heating thereof.

Recently, attempts to perform heat roll fixation without the use of such off-set preventing liquids have been made. For example, Japanese Patent Publication No. 5549/1978 discloses a method to perform the heat roll fixation without the use of an off-set preventing liquid. In addition, methods to perform the heat roll fixation without the use of an off-set preventing liquid by improving toner particles themselves are described in Japanese Patent Application (OPI) Nos. 42354/1974, 65231/1974, 65232/1974, 107743/1974, 11240/1975, 27546/1975, 28840/1975, 81342/1975, 85338/1975, 93646/1975, 93647/1975, 134652/1975, 144446/1975, etc.

These attempts to prevent the off-set phenomenon in the heat roll fixation by improving toner particles themselves without the use of an off-set preventing liquid have failed to completely satisfy the characteristics required for dry toners. That is, the friction charging properties of toner particles are different, the friction charging properties vary with the lapse of time, and the toner particles themselves cause blocking, lowering developing properties.

Recently, a press-fixation method has been used in place of the heat fixation method. In accordance with this press-fixation method, a support bearing thereon transferred toner images is introduced between a pair of press rolls, and the toner images are fixed on the surface of the support principally by means of pressure. Such toners for press-fixation are required to have the following characteristics: (1) They have a plastic deformation ability due to pressure, (2) When the application of pressure is removed, they do not fluidize; that is, the toner image after the fixation is not easily stripped or peeled apart simply by rubbing. (3) They undergo no aggregation during the storage thereof, e.g., in a toner hopper. (4) They do not form a thick toner layer on the surface of a light-sensitive medium.

To the conventional toners for press-fixation have been added wax and other additives so that the plastic deformation can be accomplished by application of pressure. In the case of such toners with wax or the like incorporated thereinto, when a fixed image is rubbed with a finger, it flows, staining a copied material; friction chargeability between toner particles is different, and it also varies with the lapse of time; and such toners cause blocking, thereby reducing developability. Furthermore, when these toners are used in combination with carriers, the toners attach onto the surface of carriers, exerting adverse influences on the friction chargeability and reducing the developability. Thus, completely satisfactory toners for press-fixation have not yet been discovered.

SUMMARY OF THE INVENTION

Accordingly, an object of the invention is to provide toners for dry development which can be rapidly fixed, permit the prevention of off-set without the use of an off-set preventing liquid, and which can be used in heat roll fixation, press-fixation, or both.

Another object of the invention is to provide toners for dry development which have good developing properties, and particularly which are stable in friction charging properties.

A further object of the invention is to provide toners for dry development which do not form a toner coating on, for example, a light-sensitive medium, and which have good cleaning properties.

Still another object of the invention is to provide toners for dry development which are improved in kneading and grinding properties, and with respect to sticking properties to a rotor, etc., during the course of production thereof.

Still another object of the invention is to provide toners for dry development which do not stain a carrier and do not cause blocking therebetween.

As a result of extensive investigations, it has now been found that the off-set phenomenon can be prevented without the use of an off-set preventing liquid by using a specific graft copolymer as a binder resin for dry toners, and that the use of such graft copolymers as binder resins permits the production of toners substantially satisfying all characteristics desired during the steps of development and cleaning, and during the production thereof.

Thus the objects of the invention are attained by using a colorant and, as binder resins for the toner, graft copolymers comprising:

(a) a crystalline polymer having a melting point ($T_M$) of from 45° C. to 200° C., which is prepared from one or more monomers selected from ethylene, propylene and vinyl acetate; and (b) an amorphous polymer having a glass transition point (Tg) of 45° C. or more, which is prepared from one or more of vinyl monomers.

DETAILED DESCRIPTION OF THE INVENTION

The amorphous polymer constituting the graft copolymer as used herein is prepared from one or more of vinyl monomers containing a polymerizable vinyl group represented by the formula: $CH_2{=}CH{-}$.

Examples of such vinyl monomers include styrenes, such as styrene, chlorostyrene and α-methylstyrene; monocarboxylic acid esters, such as methyl methacrylate, ethyl methacrylate, methyl acrylate, ethyl acrylate, n-butyl acrylate, dodecyl acrylate, and 2-chloroethyl acrylate; vinyl esters, such as vinyl chloride, vinyl fluoride, vinyl acetate, vinyl propionate, vinyl benzoate and vinyl butyrate; acrylic acid or methacrylic acid derivatives, such as acrylonitrile, methacrylonitrile and acrylamide; vinyl ethers, such as vinyl methyl ether, vinyl ethyl ether and vinyl isobutyl ether; vinylnaphthalenes; vinylketones, such as vinyl methyl ketone and vinyl hexyl ketone; and N-vinyl compounds, such as N-vinyl pyrrole, N-vinyl carbazole and N-vinyl indole.

With regard to the amorphous vinyl-based polymer chain constituting the graft copolymer as used herein, those polymer chains having theoretical glass transition points (Tg) of 45° C. or more produce the best results. The theoretical glass transition point (hereinafter, referred to merely as the "glass transition point"), i.e., Tg, is determined according to the following equation:

$$\frac{1}{Tg} = \frac{W_A}{TgA} + \frac{W_B}{TgB} + \frac{W_C}{TgC} + \cdots$$

wherein

TgA: Saturated glass transition point of a homopolymer of Monomer A

TgB: Saturated glass transition point of a homopolymer of Monomer B

TgC: Saturated glass transition point of a homopolymer of Monomer C $W_A$: Weight ratio of Monomer A to the total weight of all monomers charged $W_B$: Weight ratio of Monomer B to the total weight of all monomers charged $W_C$: Weight ratio of Monomer C to the total weight of all monomers charged.

When Tg is 45° C. or less, toners are liable to form conglomerates at room temperature. This leads not only to easy solidification of toners during the storage or transportation thereof, but also to solidification of toners in a toner hopper. Thus, problems such as poor dispersion of toners and formation of toner bridges in a toner box arise.

Preferred examples of crystalline polymers constituting the graft copolymer as used herein include polyethylene, polypropylene, an ethylene-propylene copolymer and an ethylene-vinyl acetate copolymer.

The term "crystalline polymer" as used herein indicates polymers which have sharp and distinctive melting points and which are substantially insoluble in solvents, only making them cloudy.

The melting point of the crystalline polymer as used herein is preferably from 45° C. to 200° C., although higher melting points can be used for press-fixation embodiments. When the melting point is less than 45° C., the problem of formation of conglomerates arises as in the case of Tg of the branch polymer as described hereinbefore. On the other hand, when the melting point is higher than 200° C., heat-fixation at sufficiently low temperatures becomes impossible. That is, since the proportion of the amorphous polymer is high, even if the crystalline phase is in the unmelted state, the toner is able to sufficiently melt and flow within the fixation temperature range that the toner temperature is from about 100° C. to about 200° C. However, if the melting point of the crystalline polymer is higher than 200° C., depending on the ratio of the amorphous polymer to the crystalline polymer, the toner does not melt and flow within the fixation temperature range of 100° C. to 200° C. Thus, the fixation cannot be accomplished unless the heat roll temperature is increased to an unduly high level. Furthermore, it is still difficult to prevent the off-set without the use of an off-set preventing liquid.

The glass transition point (Tg) of the crystalline polymer as used herein is preferably 20° C. or less and more preferably from 20° C. to −100° C. With regard to the molecular weight of the crystalline polymer, it is preferred that the number average molecular weight ($\overline{Mn}$) is from 1,000 to 20,000 and the weight average molecular weight ($\overline{Mw}$) is from 2,000 to 100,000. Particularly, in the case of polyethylene, polypropylene and an ethylenepropylene copolymer, relatively low molecular weight polymers, i.e., having $\overline{Mn}$ of from 1,500 to 7,000 and $\overline{Mw}$ of from 2,000 to 15,000 are preferred.

In the case of an ethylene-vinyl acetate copolymer, it is not required to have a low molecular weight, but is required to have Tg of 20° C. or less. When vinyl acetate is used as a comonomer, the proportion of vinyl acetate comonomer is preferably from 10 to 40% by weight, and more preferably from 10 to 20% by weight, based on the total weight of monomers of the crystalline polymer.

With regard to the ratio of the amorphous polymer to the crystalline polymer in the graft copolymer as used in heat-fixable embodiments of the invention, combinations of from 70 to 99% by weight of the amorphous polymer and from 30 to 1% by weight of the crystalline polymer produce good effects. When the crystalline polymer is less than 1% by weight, the effect of preventing off-set cannot be obtained. On the other hand, when it is greater than 30% by weight, the fix-initiation temperature of the toner increases and the fixability is deteriorated, and furthermore the grindability is redued. Preferably, the crystalline polymer constitutes from 5 to 15% by weight of the graft copolymer.

In order to prepare the desired press-fixable toner of the invention, the ratio of the amorphous polymer to the crystalline polymer must be determined approximately. When the crystalline polymer constitutes from 15 to 70% by weight, and preferably from 20 to 50% by weight, of the graft copolymer, and the amorphous polymer constitutes from 85 to 30% by weight, and preferably from 80 to 50% by weight, of the graft copolymer, the press-fixable toner of the invention can be prepared. When the proportion of the crystalline polymer portion is less than 15% by weight, sufficient plastic deformation ability necessary for the press-fixation cannot be obtained. Also, when the proportion of the crystalline polymer portion is greater than 70% by weight, the grindability decreases, and no stable friction chargeability or developability can be obtained.

The graft copolymer as used herein is preferably prepared so that the glass transition point is from 40° C. to 70° C., the number average molecular weight $\overline{Mn}$ is from 5,000 to 30,000, and the weight average molecular weight $\overline{Mw}$ is from 30,000 to 500,000. Graft copolymers satisfying the foregoing requirements can be prepared by methods heretofore known. In accordance with a preferred method, vinyl monomers for use in the preparation of the amorphous polymer are graft-polymerized onto the crystalline polymers which have been previously prepared.

As the binder resin for the toner, the foregoing polymer may be used alone or in admixture with other resins to improve the toner characteristics within the range that the effects of the invention are not deteriorated.

As the colorant for use in the dry toner of the invention, known pigments and dyes can be used. The colorant is used in an amount sufficient to color the binder resin. It is generally added in an amount up to 25% by weight, and preferably from 1 to 20% by weight, based on the weight of the toner. Examples of colorants which can be used include carbon black, Nigrosine dye, Aniline Blue, Alcoyl Blue, chrome yellow, Ultramarine Blue, Du Pont Oil Red, Quinoline Yellow, Methylene Blue, Phthalocyanine Blue, Malachite Green, lamp black, and Rose Bengale.

Furthermore, magnetic powder may be incorporated into the toner, and the resulting toner may be used singly as a developer without the use of a carrier.

Examples of such magnetic powders which can be used include metal powders, e.g., iron, manganese, nickel, cobalt and chromium, alloys and compounds of iron, manganese, nickel, cobalt, etc., e.g., ferrite and magnetite, and other ferromagnetic alloys which have heretofore been known as magnet materials.

The dry toner of the invention may be prepared by various techniques, including a method in which the graft copolymer comprising the crystalline polymer and the amorphous polymer is mixed with the colorant, and the mixture thus prepared is melt-kneaded and ground into fine powder to provide the dry toner, and a method in which the graft copolymerization is carried out in the presence of the colorant to provide a colored resin, and the colored resin thus prepared is shaped into fine powder either as is or by a spray dry process.

The average particle size of the toner is typically about 30μ or less, and preferably from 10μ to 20μ.

Other additives may also be added to the toner or developer, such as a charge-controlling agent and a plasticizer.

The toner of the invention is then mixed with a carrier to prepare a developer, or alternatively, by incorporating, as described above, magnetic material powder into the toner, the toner may be used singly as a developer without the use of a carrier.

A visualized toner image is provided on a light-sensitive medium or electrostatic material film bearing thereon an electrostatic latent image by a cascade developing method or magnetic brush developing method using the thus prepared developer with or without contact with the light-sensitive medium or electrostatic material film. The toner image thus formed is transferred to a support, e.g., paper.

Then, in heat fixable embodiments, the support bearing thereon the toner image transferred is passed through a pair of heat rolls consisting of a heat-application roll and a pressure-application roll. The roll which comes into contact with the toner image is coated with a fluorine resin, e.g., Teflon (trademark for polyfluoroethylene product of Du Pont), or silicone rubber, or is provided with a metallic surface. By passing the support between these rolls, the toner image is fixed on the support. The use of the toners of the invention permits prevention, without the use of an off-set preventing liquid, of phenomena such as attachment of toners to rolls and attachment of toners to the support. When a heat-fixable toner of the invention is employed, even if the fixation is performed with heat rolls without the use of an off-set preventing liquid, the off-set does not occur.

In the case of press-fixable embodiment, the support bearing thereon the toner image transferred is passed between a pair of press rolls provided in a press-fixation apparatus. At this time, the linear pressure of the press roll is desirably from 20 to 40 kg/cm. By the application of pressure, the toner is subjected to plastic deformation and is fixed on the support.

Furthermore, these toner particles of the invention have a uniform composition and are subject to no change in composition with the lapse of time, always providing stable friction chargeability and developability. More astonishingly, when the toner of the invention is used, no or little contamination of carriers occurs.

When conventional toners which have been prepared for the purpose of preventing off-set without the use of an off-set preventing liquid are used in combination with carriers, the toners adhere to the surface of the carriers, exerting adverse influences on the friction chargeability and reducing the developability. The toner of this invention is free from such problems encountered in the conventional toners. As can be seen from the examples as explained hereinafter, the amount of toner attached onto the surface of carriers after the formation of 100,000 copies is about 400 mg per 100 g of carriers in the case of the conventional toners, whereas in the case of the toners of the invention, it is as surprisingly as small as about 100 mg, and no other adverse influences, such as a reduction in developability, are observed.

Furthermore, the attachment of toner onto the surface of the light-sensitive medium after the cleaning thereof hardly occurs for the toners of this invention.

Still further, for the toners of the invention, the kneadability and grindability in the course of the production thereof are good, and attachment of toner to a rotor does not occur.

Moreover, the toner of the invention causes almost no formation of conglomerates, even if it is allowed to stand under high temperature and humidity conditions, and, to the extent that conglomerates are formed, they can be easily broken.

Hereinafter, the invention is explained in greater detail by reference to the following examples and comparative exampls.

COMPARATIVE EXAMPLE 1

A four-necked flask was charged with 800 ml of xylene and 10 g of tert-butylhydroperoxide. The mixture was raised in temperature, with stirring, to the reflux temperature of xylene, and was maintained at that temperature. To the mixture maintained at that temperature, 1,080 g of a mixed liquid consisting of 65 parts by weight of styrene and 35 parts by weight of n-butyl methacrylate was dropwise added over a period of 4 hours through a drip funnel. After the dropwise addition was completed, the mixture was stirred for an additional one hour at the reflux temperature of xylene. When the polymerization was completed, the reaction mixture was cooled to room temperature and the solvent was removed. The residue was vacuum-dried to provide the desired polymer. The thus prepared polymer constituted random copolymers of styrene and n-butyl methacrylate which were completely soluble in tetrahydrofuran. With regard to the molecular weight of the polymer, $\overline{Mn}$ and $\overline{Mw}$ were 20,300 and 73,500, respectively.

Subsequently, 90 parts by weight of the styrene-n-butyl methacrylate copolymer prepared as described above and 10 parts by weight of carbon black were mixed, melt-kneaded, and then finely pulverized to provide toner having an average particle diameter of 14$\mu$. This toner, in an amount of 2 parts by weight, was mixed with 100 parts by weight of iron powder (particle diameter, 100$\mu$) as a carrier to provide a developer.

Using the developer thus prepared, copying was preformed with a copying machine, XEROX Model 9200 (trademark) equipped with a heat roll fixation apparatus consisting of a pair of Teflon-coated heating and pressure-application rolls, in which no off-set preventing liquid was used. The minimum fixation temperature was about 160° C. When the fixation temperature was raised to 180° C., off-set began to occur, and as the fixation temperature was raised, the occurrence of the off-set became more pronounced.

EXAMPLE 1

In a four-necked flask were placed 120 g of polypropylene ($\overline{Mn}$=5,000: $T_M$=150° C.), 800 ml of xylene and 15 g of tert-butylhydroperoxide. The mixture was raised in temperature to the reflux temperature of xylene while stirring and then was maintained at that temperature. To the mixture maintained at that temperature, 1,080 g of a mixed liquid consisting of 65 parts by weight of styrene and 35 parts by weight of n-butyl methacrylate was dropwise added over a period of 4 hours through a dropping funnel. After the dropwise addition was completed, the resulting mixture was stirred for an additional one hour at the reflux temperature of xylene. When the polymerization was completed, the reaction mixture was cooled to room temperature and the solvent was removed. The residue was vacuum-dried to provide a polymer. The thus prepared polymer was a graft copolymer having a styrene-n-butyl methacrylate copolymer portion as the branch portion. When these graft copolymers were dissolved in tetrahydrofuran, about 10 g of an insoluble portion resulted. It is believed, therefore, that of 120 g of the polypropylene charged, 110 g of the polypropylene was graft-bonded to the styrene-n-butyl methacrylate copolymer.

The Tg of the styrene-n-butyl methacrylate copolymer portion was 68° C., and the molecular weights of the graft copolymer, $\overline{Mn}$ and $\overline{Mw}$, were 18,500 and 70,600, respectively. Then, 90 parts by weight of the graft copolymer as prepared above and 10 parts by weight of carbon black were mixed, melt-kneaded, and finely pulverized to provide a toner. Using this toner, a developer was prepared in the same manner as in Comparative Example 1, with which copying was performed in the same manner as in Comparative Example 1. The minimum fixation temperature was about 160° C., and even when the fixation temperature was raised to 180° C., no off-set occurred. On further raising the fixation temperature, the off-set was observed slightly on the heat roll at last at about 250° C.

EXAMPLE 2

In this example, the extent of attachment of the toner prepared in Example 1 to the surface of the carrier (iron powder) was examined.

Using the same copying machine as used in Example 1, 100,000 copies were produced. Thereafter, the developer was removed, and the toner remaining unattached in the developer was blown away by application of a stream of air. The toner attached onto the surface of the carrier was extracted with a solvent, and the amount of toner extracted was measured.

The amount of the toners attaching onto the surface of carriers was 100 mg per 100 g of the carriers.

For comparison, 92 parts by weight of a styrene-n-butyl methacrylate copolymer, 8 parts by weight of polypropylene (Mn=5,000) and 11 parts by weight of carbon black were mixed, melt-kneaded and finely pulverized to provide a toner. With the toner thus prepared, the amount of toner attaching onto the surface of carriers was measured and was found to be 400 mg per 100 g of the carriers.

EXAMPLE 3

Using a graft copolymer comprising 14 parts by weight of an ethylene-vinyl acetate copolymer ($\overline{Mw}$=45,000: $T_M$=75° C.), which had been prepared from 87 parts by weight of ethylene and 13 parts by weight of vinyl acetate, as a stem polymer, and 86 parts by weight of polystyrene (Tg=100° C.) as a branch polymer, the same copy testing as in Example 1 was performed. No off-set was observed until the fixation temperature was raised to 240° C.

EXAMPLE 4

A graft copolymer was prepared from 8 parts by weight of polyethylene (Mn=4,000; $T_M$=120° C.) as a stem polymer and 92 parts by weight of a styrene/n-butyl methacrylate/2-ethylhexyl acrylate terpolymer (Tg=49° C.) as a branch polymer. Using the graft copolymer thus preparing, the same copy testing as in Example 1 was performed, No off-set was observed until the fixation temperature was raised to 250° C.

COMPARATIVE EXAMPLE 2

A four-necked flask was charged with 800 ml of xylene and 10 g of tert-butylhydroperoxide. The mixture was raised in temperature to the reflux temperature of xylene, while stirring, and was maintained at that temperature. To the mixture maintained at that temperature, 1,080 g of a mixed liquid consisting of 65 parts by weight of styrene and 35 parts by weight of n-butyl methacrylate was dropwise added over a period of 4 hours through a drip funnel. After the dropwise addition was completed, the mixture was stirred for an additional one hour at the reflux temperature of xylene. When the polymerization was completed, the reaction mixture was cooled to room temperature and the solvent was removed. The residue was vacuum-dried to provide the desired polymer. The thus prepared polymer constituted random copolymers of styrene and n-butyl methacrylate which were completely soluble in tetrahydrofuran. With regard to the molecular weight, $\overline{Mn}$ and $\overline{Mw}$ were 20,300 and 73,500, respectively.

Subsequently, 65 parts by weight of the styrene-n-butyl methacrylate copolymer as prepared above, 35 parts by weight of polyethylene ($\overline{Mn}$=2,000; $T_M$=110° C.), and 10 parts by weight of carbon black were mixed, melt-kneaded and finely pulverized to provide toner having an average particle diameter of 14μ. This toner, in the amount of 2 parts by weight, was mixed with 100 parts by weight of iron powder (particle diameter: 100μ) as a carrier to provide a developer.

Using the developer thus prepared, copying was performed with a copying machine: XEROX Model 9200 (trademark) from which the heat roll fixation apparatus had been removed and, thereafter, fixation was performed with a press-fixation apparatus consisting of a pair of press rolls and a back-up roll. Although the fixability was good, the formation of fog occurred. Furthermore, on repeating continuous copying, the formation of fog became pronounced.

EXAMPLE 5

In a four-necked flask were placed 420 g of polyethylene ($\overline{Mn}$=2,000; $T_M$=110° C.), 800 ml of xylene and 15 g of tert-butylhydroperoxide. The mixture was raised in temperature to the reflux temperature of xylene while stirring and was maintained at that temperature. To the mixture maintained at that temperature, 780 g of a mixed liquid consisting of 65 parts by weight of styrene and 35 parts by weight of n-butyl methacrylate were dropwise added over a period of 3 hours through a dropping funnel. After the dropwise addition was completed, the mixture was stirred for an additional one hour at the reflux temperature of xylene. When the polymerization was completed, the reaction mixture was cooled to room temperature and the solvent was removed. The residue was vacuum-dried to provide the desired polymer. The thus prepared polymer was a graft copolymer comprising an ethylene polymer portion as a stem portion and a styrene-n-butyl methacrylate copolymer portion as a branch portion. When this graft copolymer was dissolved in tetrahydrofuran, about 20 g of an insoluble content resulted. It is believed, therefore, that of 420 g of the polyethylene charged, 400 g of the polyethylene was graft-bonded to the styrene-n-butyl methacrylate copolymer.

The Tg of the styrene-n-butyl methacrylate copolymer was 68° C., and the molecular weights of the graft copolymer, $\overline{Mn}$ and $\overline{Mw}$, were 19,000 and 69,000, respectively.

Subsequently, 90 parts by weight of the graft copolymer as prepared above and 10 parts by weight of carbon black were mixed, melt-kneaded, and then finely pulverized to provide a toner. Using this toner, a developer was prepared in the same manner as in Comparative Example 2. The thus prepared developer was subjected to the same copy testing as in Comparative Example 2, and images having excellent fixability and free from fog were formed. Although the copying was continuously performed to produce 100,000 copies, no fog was observed and sharp images were formed.

EXAMPLE 6

In this example, the extent of attachment of the toner prepared in Example 5 to the surface of carriers (iron powder) was examined.

Using the same copying machine as used in Example 5, 100,000 copies were produced. Thereafter, the developer was removed, and the toner remaining unattached in the developer was blown away by application of a stream of air. The toner attaching onto the surface of carriers was extracted with a solvent, and the amount of the toner extracted was measured.

The amount of the toner attaching onto the surface of carriers was 150 mg per 100 g of the carriers.

For comparison, 65 parts by weight of a styrene-n-butyl methacrylate copolymer, 35 parts by weight of polyethylene ($\overline{Mn}$=2,000) and 10 parts by weight of carbon black were mixed, melt-kneaded and then finely pulverized to provide a toner. With the toner thus prepared, the amount of toner attaching onto the surface of carriers was measured and found to be 600 mg per 100 g of the carriers.

EXAMPLE 7

Using a graft copolymer comprising 45 parts by weight of an ethylene-vinyl acetate copolymer ($\overline{Mw}$=45,000; $T_M$=75° C.) which had been prepared from 87 parts by weight of ethylene and 13 parts by weight of vinyl acetate, as a stem polymer, and 55 parts by weight of polystyrene (Tg=100° C.), as a branch polymer, the same copy testing as in Example 5 was performed. Images having excellent fixability which were free from fog were obtained.

EXAMPLE 8

A mixture of 100 parts by weight of a graft copolymer comprising 27 parts by weight of polyethylene (Mn=4,000; $T_M$=120° C.), as a stem polymer, and 73 parts by weight of a styrene/n-butyl methacrylate/2-ethylhexyl acrylate terpolymer (Tg=49° C.), as a branch portion, 100 parts by weight of magnetite, and 5 parts by weight of carbon black was melt-kneaded, finely pulverized and then sieved to provide magnetic toners having an average particle diameter of 13.5μ.

Then, 100 parts by weight of the magnetic toner thus prepared and 0.3 part by weight of Aerosil were stirred for one minute with a mixer.

Using the magnetic toners thus prepared, development was performed with a XEROX (trademark) Model 3500 copying machine from which the fixation and developing apparatus had been removed and which had been provided with a sleeve rotary type of magnetic toner developing apparatus. Thus, sharp images were formed. The images thus formed were then transferred to an ordinary paper and were fixed using a press-fixation apparatus. Thus, images having excellent fixability were formed.

While the invention has been described in detail and with reference to specific embodiments thereof, it will be apparent to one skilled in the art that various changes and modifications can be made therein without departing from the spirit and scope thereof.

What is claimed is:

1. A toner comprising (a) a colorant; and
(b) a graft copolymer comprising
(i) a crystalline polymer having a melting point of from 45° C. to 200° C., which is prepared from one or more monomers selected from ethylene, propylene and vinyl acetate, and
(ii) an amorphous polymer having a glass transition point of 45° C. or more, which is prepared from one or more vinyl monomers, wherein said graft polymer has a glass transition point of 40° to 70° C., a number average molecular weight of 5,000 to 30,000 and a weight average molecular weight of from 30,000 to 500,000, and wherein said crystalline polymer has a glass transition point of 20° to −100° C., a number average molecular weight of 1,000 to 20,000 and a weight average molecular weight of 2,000 to 100,000.

2. A toner as in claim 1 that is heat-fixable, wherein the proportion of the crystalline polymer is from 1 to 30% by weight based on the weight of the graft copolymer.

3. A toner as in claim 1 that is press-fixable, wherein the proportion of the crystalline polymer is from 15 to 70% by weight based on the weight of the graft copolymer.

4. A toner as in claim 1 that is heat-fixable and press-fixable, wherein the proportion of the crystalline polymer is from 15 to 30% by weight based on the weight of the graft copolymer.

5. A toner as in claim 1, wherein the crystalline polymer is polyethylene, polypropylene, or ethylene-propylene copolymer, and the number average molecular weight is from 1,500 to 7,000 and the weight average molecular weight is from 2,000 to 15,000.

6. A toner as in claim 1, wherein the crystalline polymer is a copolymer comprising vinyl acetate in an amount of from 10 to 40% by weight, based on the total weight of monomers of the crystalline polymer.

7. A toner as in claim 6, wherein the crystalline polymer is a copolymer comprising vinyl acetate in an amount of from 10 to 20% by weight, based on the total weight of monomers of the crystalline polymer.

8. A toner as in claim 2, wherein the proportion of the crystalline polymer is from 5 to 15% by weight based on the weight of the graft copolymer.

9. A toner as in claim 3, wherein the proportion of the crystalline polymer is from 20 to 50% by weight based on the weight of the graft copolymer.

10. A toner as in claim 1, 2, 3, or 4, wherein the average particle size is about 30μ or less.

11. A toner as in claim 1, 2, 3, or 4, wherein the average particle size is from 10μ to 20μ.

12. The toner of claim 1 wherein the crystalline polymer is selected from the group consisting of polyethylene, an ethylene-propylene copolymer and an ethylene-vinyl acetate copolymer.

13. A process for fixing a toner image comprising passing a support bearing thereon a toner image through a pair of heat rolls without supplying a liquid capable of preventing an off-set phenomenon to the heat rolls, said toner comprising (a) a colorant; and (b) a graft copolymer comprising (i) a crystalline polymer having a melting point of from 45° C. to 200° C., which is prepared from one or more monomers selected from ethylene, propylene and vinyl acetate, and (ii) an amorphous polymer having a glass transition point of 45° C. or more, which is prepared from one or more vinyl monomers, wherein said graft polymer has a glass transition point of 40° to 70° C., a number average molecular weight of 5,000 to 30,000 and a weight average molecular weight of from 30,000 to 500,000, and wherein said crystalline polymer has a glass transition point of 20° to −100° C., a number average molecular weight of 1,000 to 20,000 and a weight average molecular weight of 2,000 to 100,000.

14. A process as in claim 13, wherein the proportion of the crystalline polymer is from 1 to 30% by weight based on the weight of the graft copolymer.

15. A process as claimed in claim 13, wherein said crystalline polymer is selected from the group consisting of polyethylene, an ethylene-propylene copolymer and an ethylene-vinyl acetate copolymer.

16. A process for fixing a toner image comprising passing a support bearing thereon a toner image through a pair of press rolls at the linear pressure of from 20 to 40 kg/cm, said toner comprising (a) a colorant; and (b) a graft copolymer comprising (i) a crystalline polymer having a melting point of from 45° C. to 200° C., which is prepared from one or more monomers selected from ethylene, propylene and vinyl acetate, and (ii) an amorphous polymer having a glass transition point of 45° C. or more, which is prepared from one or more vinyl monomers, wherein said graft polymer has a glass transition point of 40° to 70° C., a number average molecular weight of 5,000 to 30,000 and a weight average molecular weight of from 30,000 to 500,000, and wherein said crystalline polymer has a glass transition point of 20° to −100° C., a number average molecular weight of 1,000 to 20,000 and a weight average molecular weight of 2,000 to 100,000.

17. A process as in claim 16, wherein the proportion of the crystalline polymer is from 15 to 70% by weight based on the weight of the graft copolymer.

18. A process as claimed in claim 16, wherein said crystalline polymer is selected from the group consisting of polyethylene, an ethylene-propylene copolymer and an ethylene-vinyl acetate copolymer.

* * * * *